US007236129B2

(12) United States Patent
Nilsson

(10) Patent No.: US 7,236,129 B2
(45) Date of Patent: Jun. 26, 2007

(54) APPARATUS AND METHOD FOR A MULTI-POLARIZED ANTENNA

(75) Inventor: Jack Nilsson, Medina, OH (US)

(73) Assignee: WIFI-Plus, Inc., Brunswick Hills, OH (US)

( * ) Notice: Subject to any disclaimer, the term of this patent is extended or adjusted under 35 U.S.C. 154(b) by 7 days.

(21) Appl. No.: 10/787,031

(22) Filed: Feb. 25, 2004

(65) Prior Publication Data

US 2004/0164918 A1 Aug. 26, 2004

Related U.S. Application Data

(63) Continuation-in-part of application No. 10/294,420, filed on Nov. 14, 2002, now Pat. No. 6,806,841.

(51) Int. Cl.
*H01Q 1/38* (2006.01)

(52) U.S. Cl. ..... 343/700 MS

(58) Field of Classification Search ..... 343/700 MS, 343/713, 845, 846, 711, 712
See application file for complete search history.

(56) References Cited

U.S. PATENT DOCUMENTS

| | | | | |
|---|---|---|---|---|
| 2,218,707 | A | 10/1940 | Franz | |
| 5,805,113 | A | 9/1998 | Ogino et al. | |
| 6,100,855 | A * | 8/2000 | Vinson et al. | 343/846 |
| 6,714,170 | B2 * | 3/2004 | Kleinschmidt | 343/883 |

OTHER PUBLICATIONS http://www.magneticsciences.com/UWBandVpolAnts~ns4.html, "Ultra-Wideband (UWB) and Multiband antenna for RF, microwaves and UWB".

http://www.magneticsciences.com/MultibeamSATCOMantenna~ns4.html, "Multiple Beam Antenna for Satellite Communications and LOS Communications".

http://www.northcountryradio.com/Articles/discfig2.htm, "Discone Figures".

http://kyleti.aswwc.net/index.php?page=projects&old_project+80211b_Discone, "Tim and David's 2.4 GHz802.11b Discone".

http://www.wave-report.com/tutorials/OFDM.htm, "OFDM Tutorial".

Broadband Wireless Internet Forum White Paper, "VOFDM Broadband Wireless Transmission and Its Advantages over Single Carrier Modulation; Document No. WP-1_TG-1," Boradband Wireless Internet Forum, 1.2 ed., Broadband WIreless Internet Forum, p. 1-35, (Dec. 15, 2000).

* cited by examiner

*Primary Examiner*—Hoanganh Le
*Assistant Examiner*—Huedung Mancuso
(74) *Attorney, Agent, or Firm*—Sheldon Mak Rose & Anderson PC

(57) ABSTRACT

A multi-polarized antenna for transmitting and/or receiving radio frequency (RF) signals, and a method for constructing same, is disclosed. The antenna comprises at least two radiative antenna elements each having a first end and a second end. The second ends of the antenna elements are electrically connected at an apex point and are disposed outwardly away from the apex point at an acute angle relative to and to a first side of an imaginary plane intersecting the apex point. The antenna also includes an electrically conductive ground plane located at and/or to a second side of the imaginary plane.

29 Claims, 9 Drawing Sheets

Geometric Spatial Capture of Signal

"DFDM" – Doppler Frequency Division Multiplexing

Here is an example of maximizing on a low profile obstructed environment
P-MP (Point-to-Multi-Point) deployment

APPARATUS AND METHOD FOR A MULTI-POLARIZED ANTENNA

CROSS-REFERENCE TO RELATED APPLICATIONS/INCORPORATION BY REFERENCE

This application is a continuation-in-part (C-I-P) of application Ser. No. 10/294,420 filed on Nov. 14, 2002, now U.S. Pat. No. 6,806,841, which is incorporated herein by reference in its entirety.

U.S. Pat. No. 6,496,152 issued on Dec. 17, 2002 is incorporated herein by reference in its entirety.

TECHNICAL FIELD

Certain embodiments of the present invention relate to portable and fixed antennas for wireless communications. More particularly, certain embodiments of the present invention relate to an apparatus and method providing a multi-polarized antenna exhibiting substantial spatial diversity for use in cellular telephone applications, wireless laptop and desktop personal computer (PC) applications, maritime applications, aviation applications, satellite and space applications, and planetary radio communications.

BACKGROUND OF THE INVENTION

For years, wireless communications including Wi-Fi, WWAN, and WLAN, Cell/PCS phones, Land Mobile radio, aircraft, satellite, etc. have struggled with limitations of audio/video/data transport and internet connectivity in both obstructed (indoor/outdoor) and line-of-site (LOS) deployments.

A focus on gain as well as circuitry solutions have proven to have significant limitations. Unresolved, non-optimized (leading edge) technologies have often given way to "bleeding edge" attempted resolutions. Unfortunately, all have fallen short of desirable goals, and some ventures/companies have even gone out of business as a result.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist, however, insufficient capture of the signal can result if this preferred path is not utilized.

Spatial diversity can distinctly help with some of the null-spot issues. Some radio equipment comes equipped with two switched antenna connections to reduce null spot problems experienced by a single antenna due to multi-path signals. A single antenna may receive signals out of phase from different paths, causing the resultant received signal to be nulled out (i.e., the individual signals received from the different paths cancel each other out). With two antennas, if one antenna is experiencing null cancellation, the other, if positioned properly with respect to the first antenna, will not. VOFDM (Vector Orthogonal Frequency Division Multiplexing) technology helps with some multi-path out-of-phase 'data clash' issues. Electronically steer-able antenna arrays alleviate some interference problems and provide a solution where multiple standard directional antenna/radio systems would otherwise be more difficult or clearly impractical. Dual slant polarization antenna/circuitry switching systems have shown much advantage over others in (some) obstructed environments but require additional complex circuitry. Circularly polarized systems can also provide some penetration advantages.

Certainly, gain (increased ability to transmit and receive signals in a particular direction) is important. However, if polarization of the signal and antenna are not matched, poor performance may likely result. For example, if the transmitting antenna is vertically polarized and the receiving antenna is also vertically polarized, then the transmitting and receiving antennas are matched for wireless communications. This is also true for horizontally polarized transmitting and receiving antennas.

However, if a first antenna is horizontally polarized (e.g., a TV house antenna) and a second antenna (e.g., TV transmitting antenna) is vertically polarized, then the signal received by the first antenna will be reduced, due to polarization mismatch, by about 20 dB (to about $1/100^{th}$ of the signal that could be received if polarizations were matched). For example, a vertically polarized antenna with 21 dBi of gain, attempting to receive a nearly horizontally polarized signal, is essentially a 1 dBi gain antenna with respect to the horizontally polarized signal and may not be effective.

As another example, a vertically or horizontally polarized antenna that is tilted at 45 degrees can receive both vertically and horizontally polarized signals, but at a power loss of 3 dB (½ power). However, if the signal to be received is also at a 45-degree tilt, but perpendicular to the 45-degree tilt of the receiving antenna, then the signal is again reduced to $1\frac{1}{100}^{th}$ of the potential received signal. Having two antennas where one is vertically polarized and the other is horizontally polarized can help, but still has its disadvantages.

Therefore, gain is important but, to be effective, polarization should be considered as well.

Further limitations and disadvantages of conventional, traditional, and proposed approaches will become apparent to one of skill in the art, through comparison of such systems with the present invention as set forth in the remainder of the present application with reference to the drawings.

BRIEF SUMMARY OF THE INVENTION

An embodiment of the present invention provides an apparatus comprising a multi-polarized antenna for transmitting and/or receiving radio frequency (RF) signals. The antenna comprises at least two radiative antenna elements each having a first end and a second end. The second ends of the radiative antenna elements are electrically connected at an apex point and are each disposed outwardly away from the apex point at an acute angle relative to and on a first side of an imaginary plane intersecting the apex point. The antenna also includes an electrically conductive ground plane located at and/or to a second side of the imaginary plane.

An embodiment of the present invention includes a method to construct a multi-polarized antenna for transmitting and/or receiving radio frequency (RF) signals. The method comprises generating at least two radiative antenna elements each having a first end and a second end and each being tuned to a predetermined radio frequency. The method further comprises electrically connecting the second ends of the radiative antenna elements at an apex point such that each radiative antenna element is disposed outwardly away from the apex point at an acute angle relative to and on a first side of an imaginary plane intersecting the apex point. The method further includes positioning an electrically conductive ground plane at and/or to a second side of the imaginary plane.

An embodiment of the present invention includes a stacked configuration of antennas for improving gain along a particular spatial dimension. The stacked configuration comprises at least two antennas co-linearly positioned in spatial proximity to each other along an imaginary line and having substantially the same spatial orientation. The antennas each comprise at least two radiative antenna elements each having a first end and a second end, and wherein the second ends of the radiative antenna elements are electrically connected at an apex point and are each disposed outwardly away from the apex point at an acute angle relative to and on a first side of an imaginary plane intersecting the apex point. Each antenna of the stacked configuration further includes an electrically conductive ground reference located at and/or to a second side of the imaginary plane.

These and other advantages and novel features of the present invention, as well as details of an illustrated embodiment thereof, will be more fully understood from the following description and drawings.

DETAILED DESCRIPTION OF THE INVENTION

Figure 1:
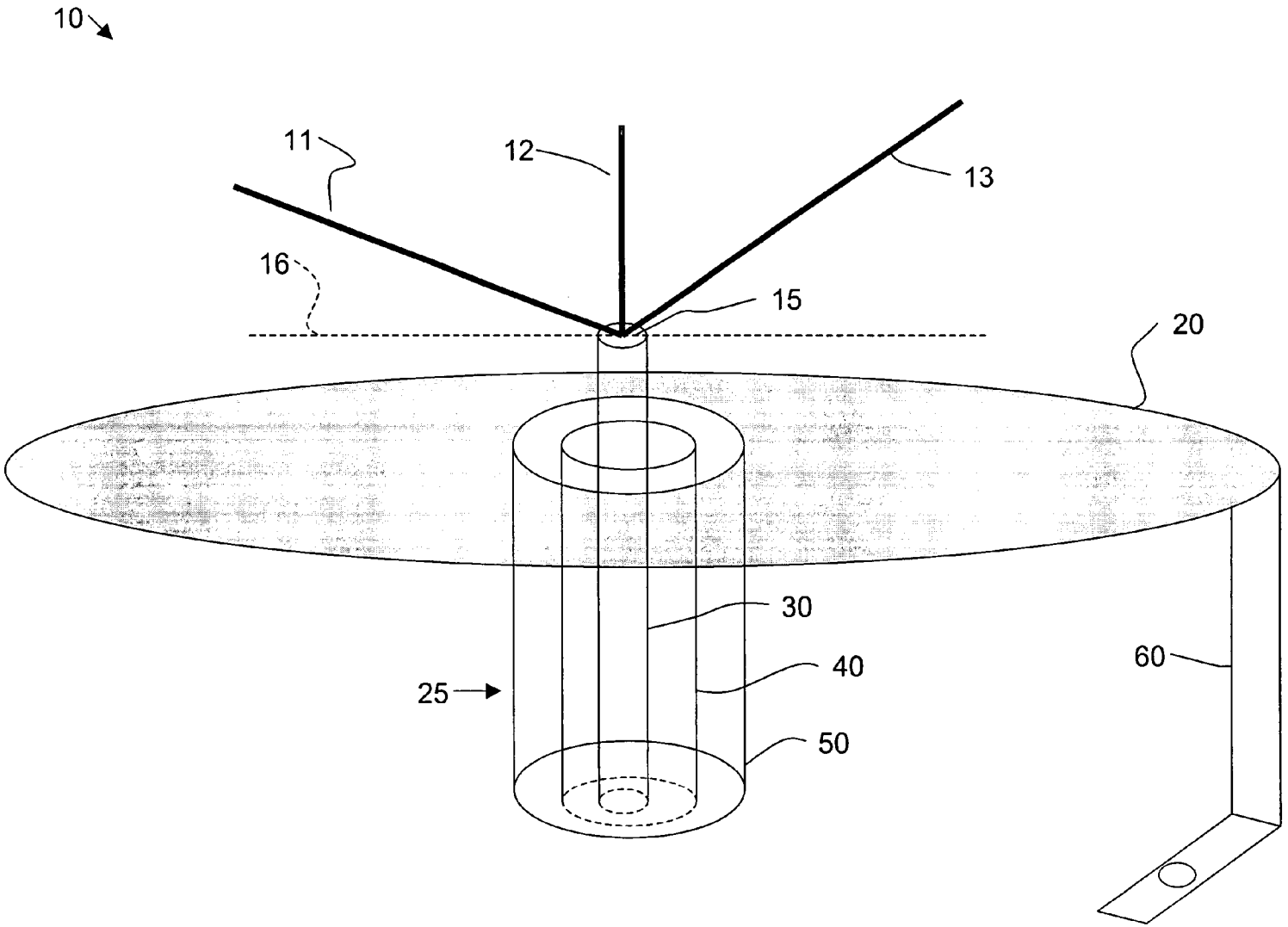
FIG. 1 illustrates a first embodiment of a multi-polarized antenna, in accordance with various aspects of the present invention.

FIG. 1 illustrates a first embodiment of a multi-polarized antenna 10, in accordance with various aspects of the present invention. The multi-polarized antenna 10 comprises a first radiative antenna element 11, a second radiative antenna element 12, and a third radiative antenna element 13. The three radiative antenna elements 11-13 are electrically connected together at an apex point 15 such that the three radiative antenna elements 11-13 are disposed outwardly away from the apex point 15 at an acute angle of between 1 degree and 89 degrees relative to an imaginary plane 16 intersecting the apex point 15. The radiative antenna elements 11-13 are all located to a first side of the imaginary plane 16.

In accordance with an embodiment of the present invention, each radiative antenna element 11-13 is substantially linear, coiled or not, and having two ends. Each radiative antenna element 11-13 may be at a unique acute angle or at the same acute angle relative to the imaginary plane 16. In accordance with an embodiment of the present invention, the three radiative elements 11-13 are spaced circumferentially at 120 degrees from each other. Other spacings are possible as well.

The multi-polarized antenna 10 further includes an electrically conductive ground plane 20 that is located at and/or to a second side of the imaginary plane 16 opposite that of the radiating antenna elements 11-13. In accordance with an embodiment of the present invention, the ground plane 20 is substantially parallel to the imaginary plane 16. The multi-polarized antenna 10 also includes an electrical connector (e.g., a coaxial connector) 25 which comprises a center conductor 30, an insulating dielectric region 40, and an outer conductor 50. The electrical connector 25 serves to mechanically connect the three radiative antenna elements 11-13 to the ground plane 20 and to allow electrical connection of the radiative antenna elements 11-13 and the ground plane 20 to a transmission line for interfacing to a radio frequency (RF) transmitter and/or receiver. For example, the center conductor 30 electrically connects to the apex 15 of the radiative antenna elements 11-13 and the outer conductor 50 electrically connects to the ground plane 20. The insulating dielectric region 40 electrically isolates the center conductor 30 (and therefore the radiative antenna elements 11-13) from the outer conductor 50 (and therefore from the ground plane 20). The insulating dielectric region 40 may also serve to mechanically connect the radiative antenna elements 11-13 to the ground plane 20, in accordance with an embodiment of the present invention.

The antenna 10 also includes a mounting mechanism 60 to mount the antenna 10 to a structure (e.g., a car, a tower, a building) or another device (e.g., a personal computer, a cell phone). In accordance with an embodiment of the present invention, the mounting mechanism 60 may be mechanically connected to the ground plane 20.

In accordance with other embodiments of the present invention, the number of radiative antenna elements may be only two or may be greater than three. For example, four radiative antenna elements circumferentially spaced at 90 degrees, or otherwise, may be used. In fact, a large number of radiative antenna elements may be effectively replaced with a continuous surface of a cone, a pyramid, or some other continuous shape that is spatially diverse on one side (i.e., has significant spatial extent) and comes substantially to a point (e.g., an apex) on the other side. For example, in accordance with an embodiment of the present invention, a linear radiative antenna element connected at one end to a radiative loop having a certain spatial extend may be used.

In accordance with other embodiments of the present invention, the ground plane 20 may comprise, for example, a rectangular conductive ground plane having a length and width of at least ¼ wavelength of a tuned radio frequency. The ground plane 20 may comprise a triangular conductive ground plane having minimum distances from the center of the triangular conductive ground plane to the sides of the triangular conductive ground plane of at least ¼ wavelength of a tuned radio frequency. The ground plane 20 may comprise a plurality of conductive linear rods each having a length of at least ¼ wavelength of a tuned radio frequency. However, the less contiguous the ground plane, the less bandwidth the antenna will have.

Figure 2:
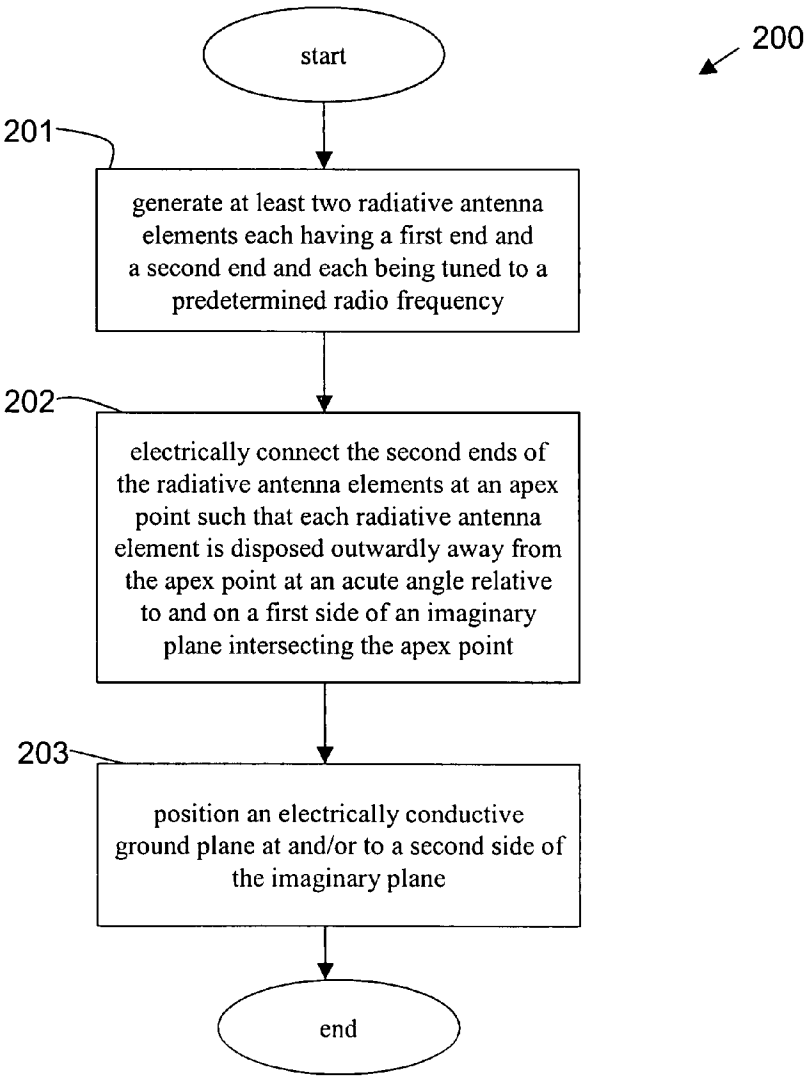
FIG. 2 is a flowchart of an embodiment of a method to construct the antenna of FIG. 1, in accordance with various aspects of the present invention.

FIG. 2 is a flowchart of an embodiment of a method 200 to construct the antenna 10 of FIG. 1, in accordance with various aspects of the present invention. In step 201, at least two radiative antenna elements are generated, each having a first end and a second end and each being tuned to a predetermined radio frequency. In step 202, the second ends of the radiative antenna elements are electrically connected together at an apex point such that each radiative antenna element is disposed outwardly away from the apex point at an acute angle relative to and on a first side of an imaginary plane intersecting the apex point. In step 203, an electrically conductive ground reference is positioned at and/or to a second side of the imaginary plane.

In accordance with various embodiments of the present invention, each radiative antenna element may be tuned to a different radio frequency, to the same radio frequency, or to some combination thereof. For example, in accordance with an embodiment of the present invention, each radiative antenna element 11-13 is cut to a physical length that is approximately one-quarter wavelength of a desired radio frequency of transmission. The ground plane 20 comprises a circular disk with a physical radius of 1-¼ wavelengths. Also, in general, the bigger the ground plane, the more broad banded the antenna and both the vertically and multi-polarized signals have higher elevation patterns. The radius of the ground plane should be at least one-quarter of a wavelength, however.

With all properties including inductive reactance, capacitive reactance and resistive impedance components of the antenna elements and elemental interactions considered, there is a resultant tri-band impedance matched broadband performance at ¼ λ, ⅜ λ, and 0.7 λ related frequency (cut) areas. The antenna becomes even more broad banded by using unequal length radiative antenna elements such as, for example, 1.0x, 1.1x, and 0.9x lengths, where x is some initial length of one of the antenna elements. With these issues and adaptations of the well-known k-factor, final lengths are cut per analysis.

In accordance with an embodiment of the present invention, for an antenna 10 tuned to approximately 2.4 GHz with the radius of the circular ground plane 20 being 4 inches, the antenna 10 provides a gain of approximately 5 dBi.

In accordance with an embodiment of the present invention, the antenna 10 of FIG. 1 may be enclosed in a protective housing that is transparent to electromagnetic waves. This helps to protect the antenna 10 from various detrimental environmental effects due to, for example, wind and rain.

Figure 3:
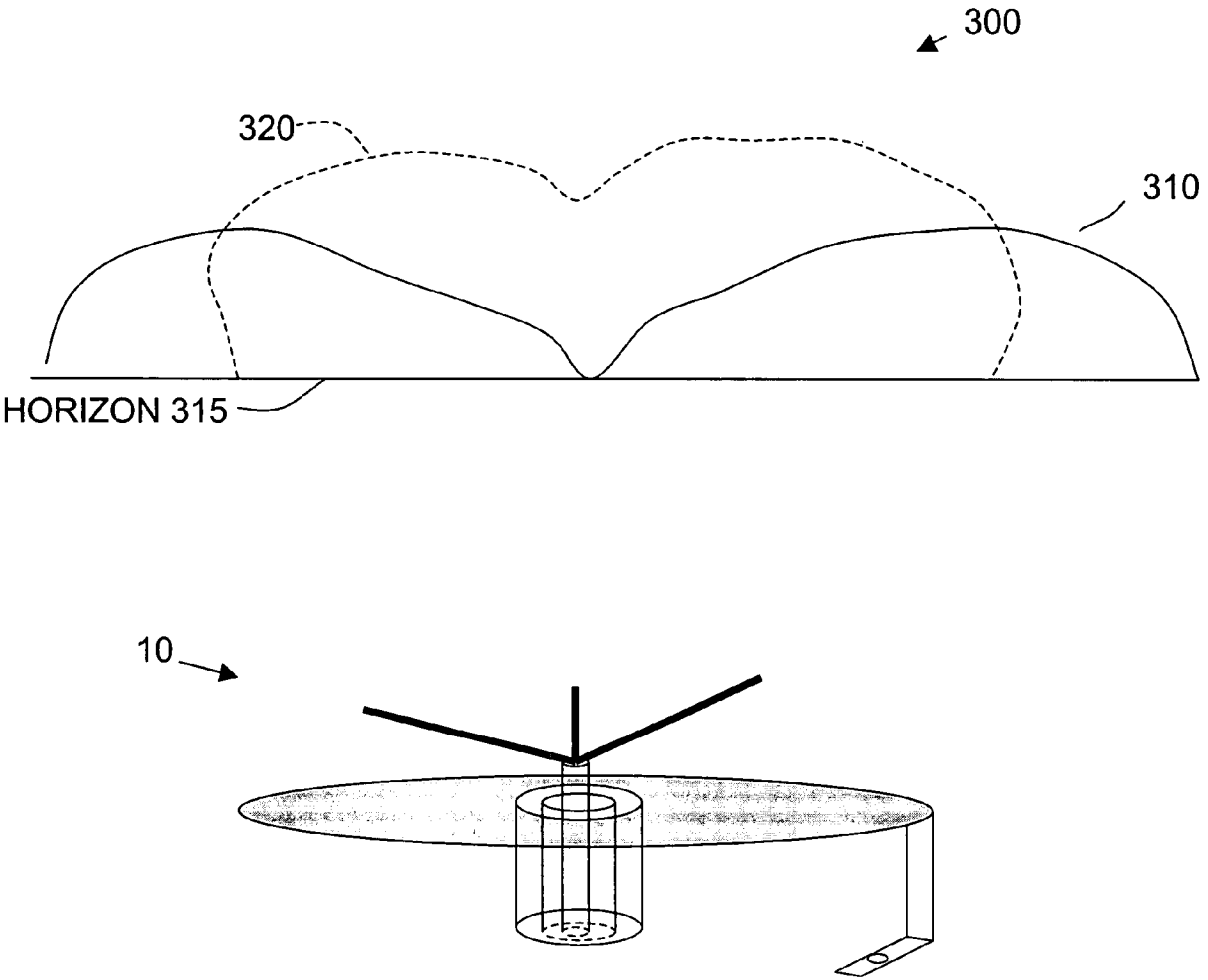
FIG. 3 illustrates the elevation antenna pattern of the multi-polarized antenna of FIG. 1, in accordance with an embodiment of the present invention.

FIG. 3 illustrates the elevation antenna pattern 300 of the multi-polarized antenna 10 of FIG. 1, in accordance with an embodiment of the present invention. The antenna 10 of FIG. 1 is highly omni-directional, for example, above the horizon. The antenna of FIG. 1 produces a vertically polarized signal with high gain near the horizon and produces a multi-polarized prominence that continues up to 90-degrees in elevation for out-of-the-valley and tower/building/satellite performance. With the antenna 10 positioned with the radiative antenna elements pointing generally upward and the ground plane being parallel to the surface of the earth, the elevation antenna pattern 300 comprises a first antenna pattern component 310 and a second antenna pattern component 320. The first component 310 is strongly directed toward the horizon 315 and is mainly vertically polarized (i.e., the E-field of the transmitted signal is vertically oriented). The second component 320 is directed more upwardly and is multi-polarized (i.e., the E-field of the transmitted signal is oriented in multiple spatial directions). As a result, the multi-polarized antenna 10 not only has excellent performance at and near the horizon 315, but also from above at multiple polarizations.

For example, if antenna 10 is sitting in a valley and is connected to a personal computer for wireless connection to the Internet, the antenna 10 may still be able to reliably connect to the Internet by taking advantage of a preferred polarized path signal of the second component 320 upward and out of the valley. A personal computer using a simple vertically polarized antenna may not be able to transmit and receive reliably out of the valley to establish a connection to the Internet.

Figure 4:
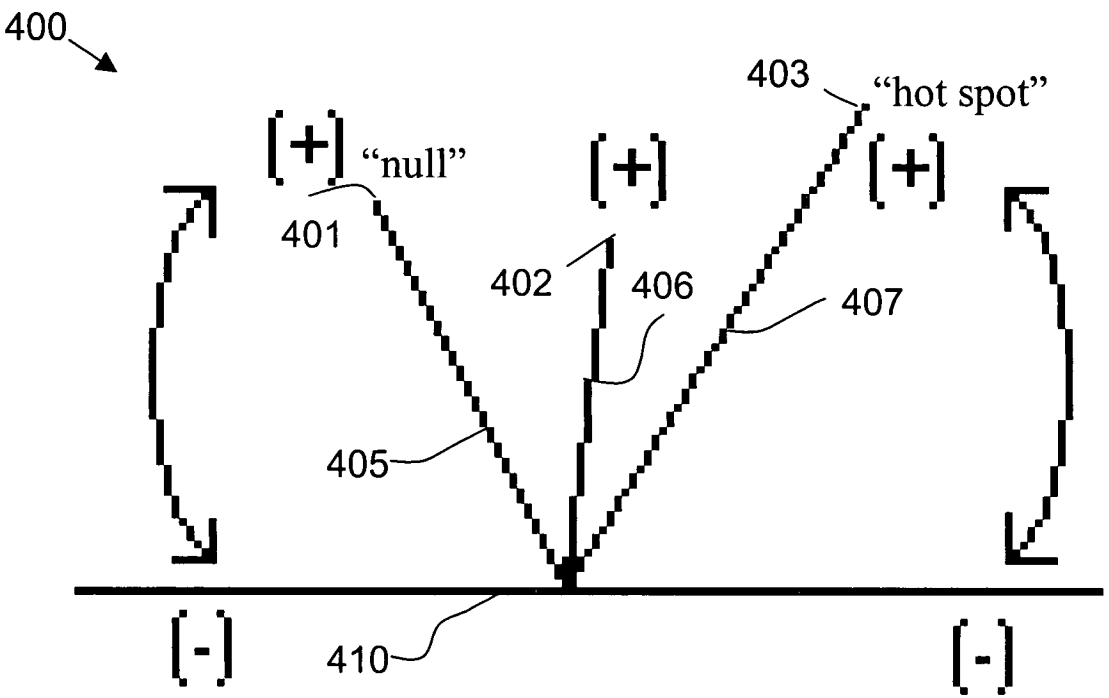
FIG. 4 illustrates the concept of geometric spatial capture of signal provided by the antenna of FIG. 1, in accordance with various aspects of the present invention.

FIG. 4 illustrates the concept of geometric spatial capture of signal provided by the antenna 400 of FIG. 1, in accordance with various aspects of the present invention. The first ends 401, 402, and 403 of the three radiative antenna elements 405, 406, and 407 are spatially separated from each other over the ground plane 410. Radio frequency multi-path signals originating at some other source and intersecting the antenna 400 may produce a "null" or cancellation (dead or very low signal) at radiative antenna element 401 but produce a "hot spot" or strong signal at radiative antenna element 403. As a result, the signal may still be received by the antenna 400 because of the spatial diversity of the radiative antenna elements 405-407. If the antenna 400 is connected to a mobile device such as a cell phone, the unwanted effect of signal fluttering (alternating weak and strong signal reception normally experienced with a single element antenna while in motion) is greatly reduced if not totally eliminated due to the spatial diversity (i.e., spatial separation) of the ends 401-403 of the radiative antenna elements 405-407. This capability is known as "geometric spatial capture of signal".

Figure 5:
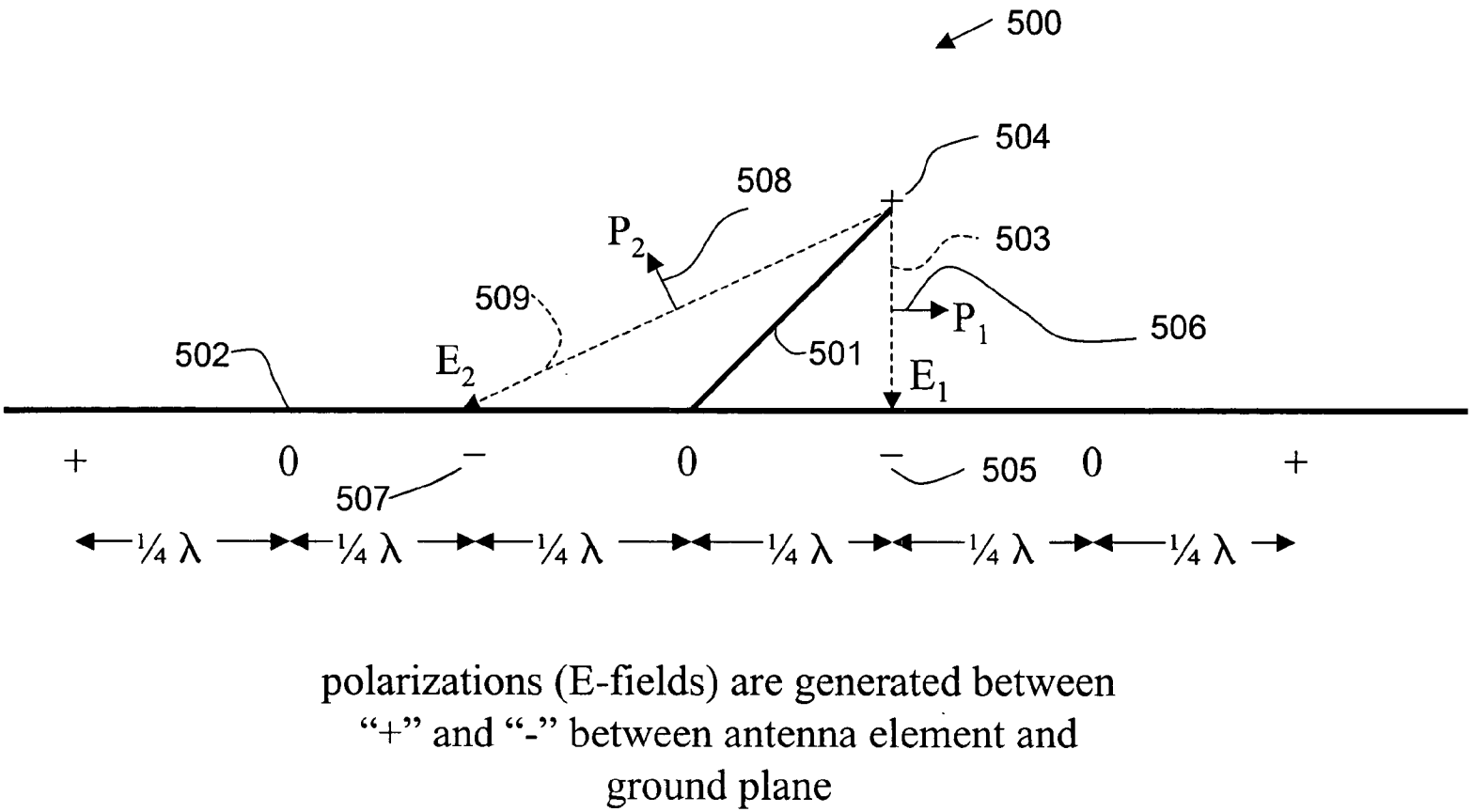
FIG. 5 illustrates the concept of multi-polarization provided by the antenna of FIG. 1, in accordance with various aspects of the present invention.

FIG. 5 illustrates the concept of multi-polarization provided by the antenna 10 of FIG. 1, in accordance with various aspects of the present invention. Polarization (i.e., the direction of the electric field vector E in the far field) is determined largely by the orientation of the radiative antenna element with respect to the ground plane. The direction of propagation of the resultant electromagnetic wave is perpendicular to the electric field vector. In FIG. 5, a single, slanted radiative antenna element 501 is shown over a ground plane 502 to form the antenna 500. When a sinusoidal voltage signal is fed into the antenna 500 (e.g., via a transmission line), alternating electric charge is formed on the radiative antenna element 501 and the ground plane 502. The "+" symbols represent positive charge corresponding to the positive peaks of the sinusoidal signal, the "−" symbols represent negative charge corresponding to the negative peaks of the sinusoidal signal, and the "0" symbols represent the zero crossing points of the sinusoidal signal feeding the antenna 500. The "+", "−", and "0" charges are separated across the ground plane by one-quarter wavelength (¼ λ)) as would be expected based on a sinusoidal waveform.

The illustration in FIG. 5 is a snapshot in time of the charges on the radiative antenna element 501 and the ground plane 502. As can be seen in FIG. 5, different polarizations or radiated electric (E) fields will be generated between the "+" on the end of the radiative antenna element 501 and the "−"'s on the ground plane 502. For example, an E-field ($E_1$) 503 is generated between the "+" 504 and the "−" 505 and propagates outward from the antenna 500 in the direction $P_1$ 506 which is perpendicular to $E_1$ 503. There is also a corresponding magnetic field $M_1$ (not shown) associated with $E_1$ to form a complete, radiating electromagnetic wave. $E_1$ 503 is substantially vertical and, therefore, tends to generate a vertically polarized signal in the far field (corresponding to the first antenna pattern component 310 of FIG. 3).

Another E-field ($E_2$) 509 is seen to be generated between the "+" 504 and the "−" 507 and propagates outward from the antenna 500 in the direction $P_2$ 508 which is perpendicular to $E_2$ 509. There is also a corresponding magnetic field $M_2$ (not shown) associated with $E_2$ to form a complete, radiating electromagnetic wave. $E_2$ 509 is substantially slanted upward and, therefore, tends to generate an upward-directed slant polarized signal in the far field (corresponding to the second antenna pattern component 320 of FIG. 3).

FIG. 5 shows polarizations in only two directions. Other polarizations are formed in other directions as well when going 360 degrees laterally around the radiative antenna element 501. Also, each of the radiative antenna elements 11-13 interact with each other, as well as with the ground plane. For example, electromagnetic radiation from two elements of the radiative antenna elements 11-13 can interact with each other to create a relatively strong radiated field in a direction that is substantially perpendicular to an imaginary line between the first ends of the two radiative antenna elements. The resultant impedance of the antenna 10 at a particular frequency of operation is a function of, at least in part, the spatial relationships between the radiative antenna elements 11-13.

When multiple radiative antenna elements (e.g., three) are positioned over a ground plane and properly spaced, many more polarizations may be generated and/or received in many more different directions. Therefore, such an antenna is said to be "'multi-polarized" as well as providing "geometric spatial capture of signal". If a transmitting antenna produced all polarizations in all planes (i.e., all planes in an x, y, z coordinate system) and the receiving antenna is capable of capturing all polarizations in all planes, then the significantly greatest preferred polarization path (maximum amplitude signal path) may be availably utilized.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antenna 10 of FIG. 1 is able to capture or utilize the preferred approaching signal whether the preferred (greatest magnitude) signal is a line-of-site signal or a reflected signal, and no matter how the signal is polarized.

Figure 6:
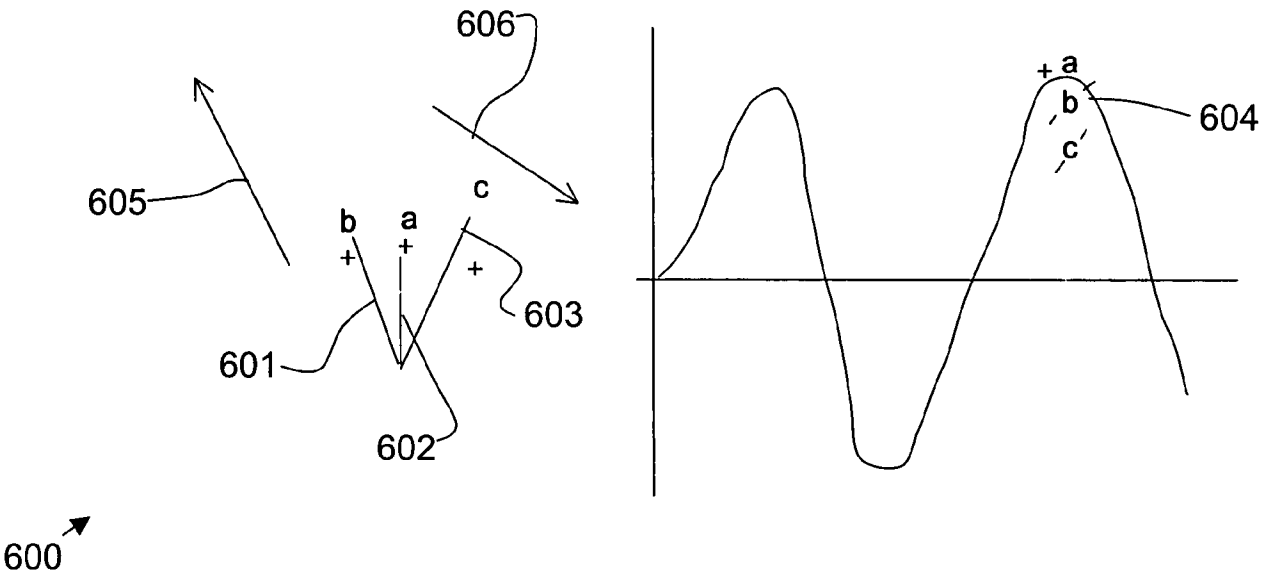
FIG. 6 illustrates the concept of Doppler Frequency Division Multiplexing provided by the antenna of FIG. 1, in accordance with various aspects of the present invention.

FIG. 6 illustrates the concept of Doppler Frequency Division Multiplexing (DFDM) provided by the antenna of FIG. 1, in accordance with various aspects of the present invention. When two active (radiative) vertical ¼ wavelength elements are separated from each other by ¼ wavelength and are both fed a radio frequency signal in phase, a prominence of azimuth signal pattern occurs about a line midway and perpendicular to the line that joins the two active elements. Also, if the two vertical ¼ wavelength elements are fed out of phase by ¼ wavelength, a clear prominence occurs in the direction of the delay-fed element. This is known as a phase-shift directive.

Phase shift directives may also occur with pairs of the slanted radiative antenna elements 601-603 of the antenna 600 shown in FIG. 6. In the antenna 600 of FIG. 6, each radiative antenna element 601-603 transmits signals (a, b, c) of the same frequency but at a slightly different time (or phase) with respect to each other because of the slightly different lengths of the radiative antenna elements 601-603. As a result, based on vector analysis (vector summation 604 of a, b, c signals) of such scenarios, phase-shift directives (e.g., 605 and 606) can occur.

Particularly in a multi-antenna array, these phase-shift directives may be beneficial in and of themselves individually per antenna in non-line-of-sight (NLOS) scenarios and in a statistically advantageous manner with multiple antennas for maintenance of some usable signal.

Furthermore, when a driven antenna 600 is mechanically rotated on axis (i.e., spun), with the phase-shift directives considered, the benefits of (V)OFDM circuitry are further mimicked and called Doppler Frequency Division Multiplexing (DFDM). An optimized rotation rate may be found in a stable NLOS environment and continued variations in the rotation rate may benefit performance in a changing obstructed environment. The rotation rate may be accomplished by connecting a small electric motor, for example, to the antenna 600 or to the antenna 10 of FIG. 1, in accordance with various embodiments of the present invention.

Certain circuit technology that, when combined with the antenna technologies herein may produce even further benefits, include (V)OFDM, switching phased arrays, Doppler switching circuitry of the active slant elements, and circular phase delay (circuit board strips, etc.) feed of the active slant elements. Although terrestrial and satellite signals are benefited by the basic technology described herein, the combination with the circular phase delay feed technology has been shown to clearly improve mobile (data) satellite radio performance (e.g., XM, Sirius).

Indoor and outdoor obstructions can produce reflections, diffractions, refractions, and scattering of radio waves. The multi-polarized antenna of FIG. 1 is able to receive all polarizations and capture the changing, highly preferred (i.e., best polarization) pathway, holding the communication where standard antennas fall short.

With each side of a communication link using the antenna of FIG. 1, signals of all polarizations are produced upon transmission. These multiple signals may all be received and, due to the geometric design of the antenna of FIG. 1, a plurality of the multiple signals tend to add together in phase in line-of-sight (LOS) and non-line-of-sight (NLOS) (where maximum signal is still of a direct point-to-point pathway and there is a most preferred maximum penetration polarization) scenarios upon reception. Any singularly polarized noise from out-of-phase multi-path or signals from other sources account for just a small part of the total.

Figure 7:
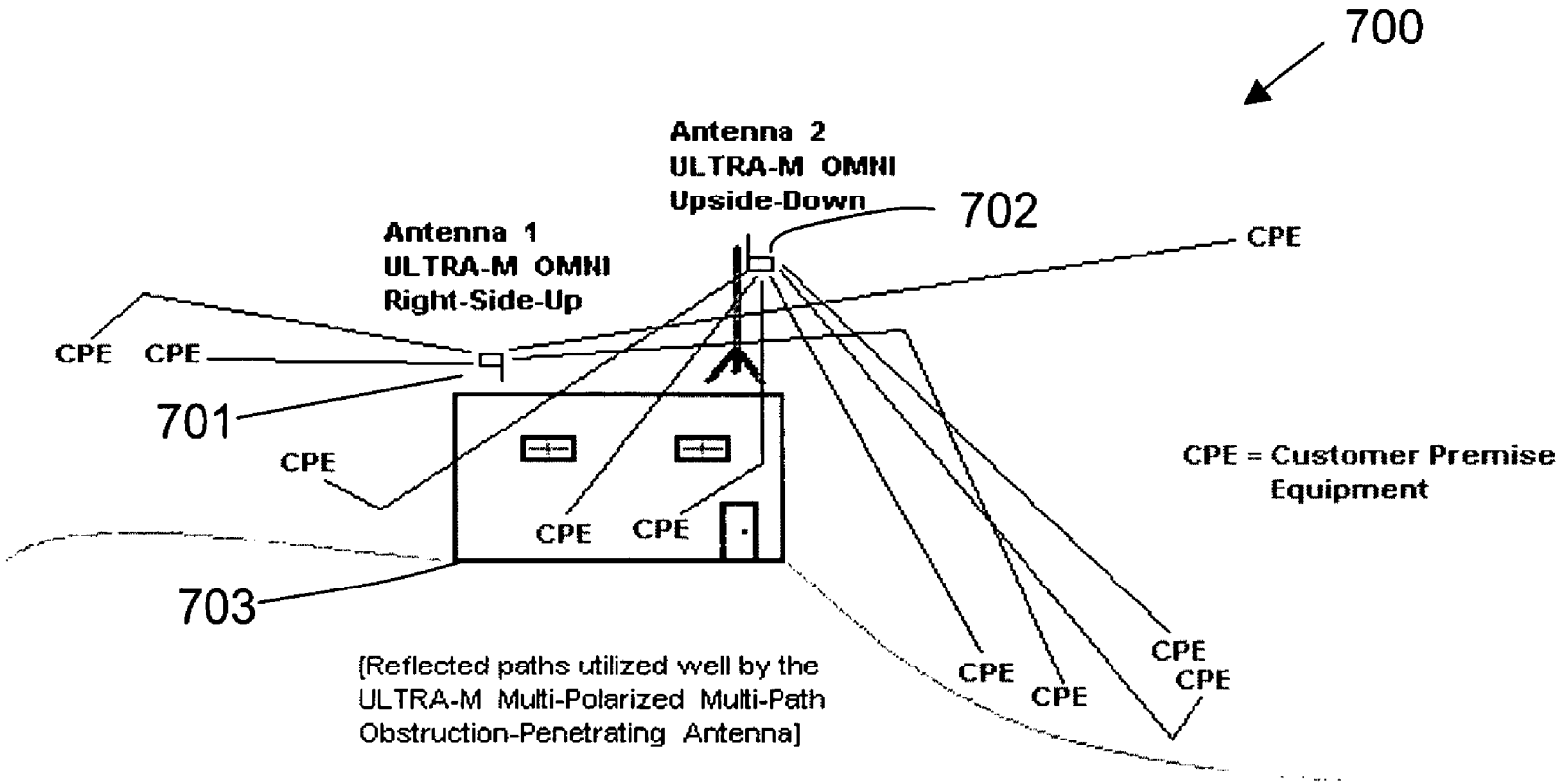
FIG. 7 illustrates an embodiment of an application using two antennas of FIG. 1, in accordance with various aspects of the present invention.

FIG. 7 illustrates an embodiment of an application 700 using two antennas 10 of FIG. 1, in accordance with various aspects of the present invention. A first antenna 701 is positioned right side up on a front of a building 703. A second antenna 702 is positioned upside-down on a back of the building 703. By using the two antennas 701 and 702, communication with various customer premise equipment (CPE), located at various angles with respect to the two antennas 701 and 702 in a low-profile obstructed environment, may be achieved. Both line-of-site (LOS) and reflected paths are well utilized by the two multi-polarized antennas 701 and 702.

Figure 8:
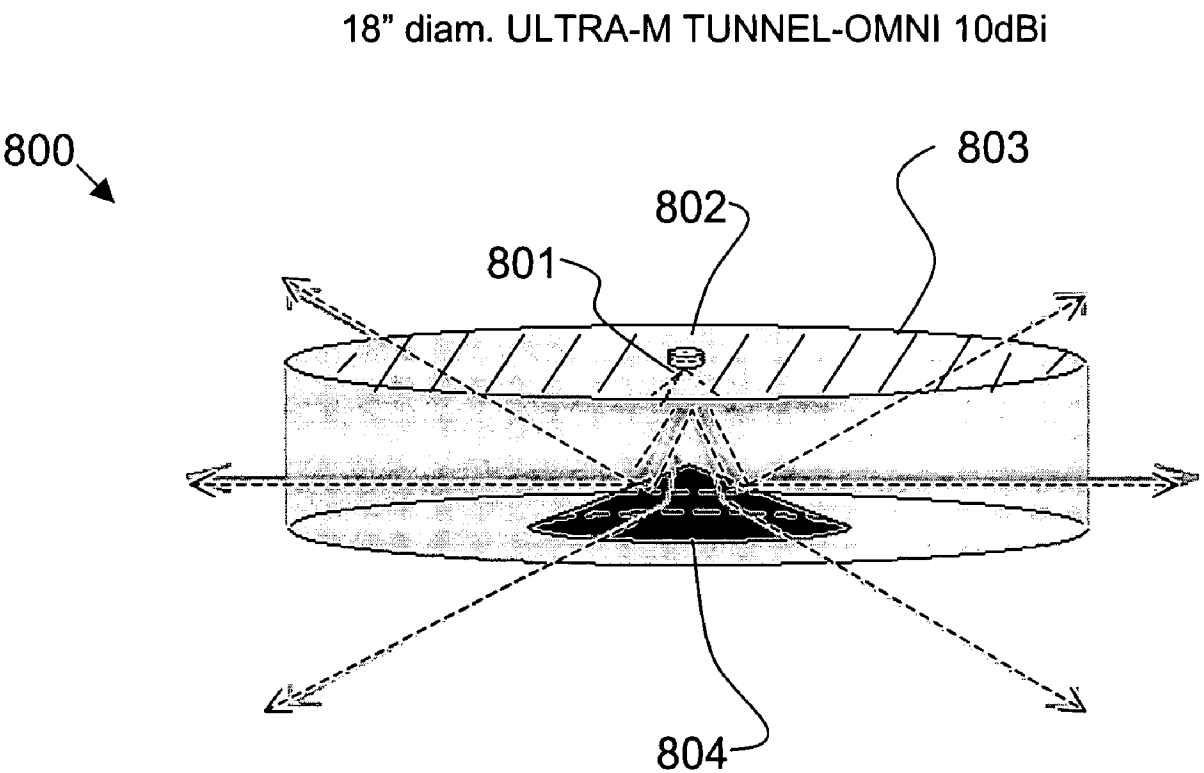
FIG. 8 illustrates a second embodiment of a multi-polarized antenna, in accordance with various aspects of the present invention.

FIG. 8 illustrates a second embodiment of a multi-polarized antenna 800, in accordance with various aspects of the present invention. The antenna includes three radiative antenna elements 801, an electrical connector 802, and a ground plane 803 similar to the antenna 10 of FIG. 1 and further includes a parasitic conductive reflector 804 positioned away from the open side (non-apex side) of the radiative antenna elements 801. In an embodiment of the present invention, the parasitic conductive reflector 804 is conically shaped with a central axis of the reflector 804 pointed at the apex point of the electrically connected radiative antenna elements 801. The base of the reflector 804 is parallel to the ground plane 803. The reflector 804 serves to reflect multi-polarized transmitted radio frequency signals from the radiative antenna elements 801 in a direction substantially orthogonal to the central axis of the conically shaped reflector 804 for 360 degrees, providing more overall gain in the lateral directions. Similarly, reflector 804 serves to reflect radio frequency signals, received substantially laterally from another source, to the radiative antenna elements 801, providing more overall lateral gain upon reception. In accordance with various embodiments of the present invention, the parasitic conductive reflector 804 may comprise other shapes as well such as for example, a flat plane conductor, an inverse parabolic-shaped conductor, or any other shaped parasitic conductor that provides increased gain, in at least one spatial direction, over the antenna 10 of FIG. 1. In accordance with various embodiments of the present invention, the ground plane and/or parasitic reflector may comprise a plurality of parasitic elements that are electrically contiguous or not.

Figure 9:
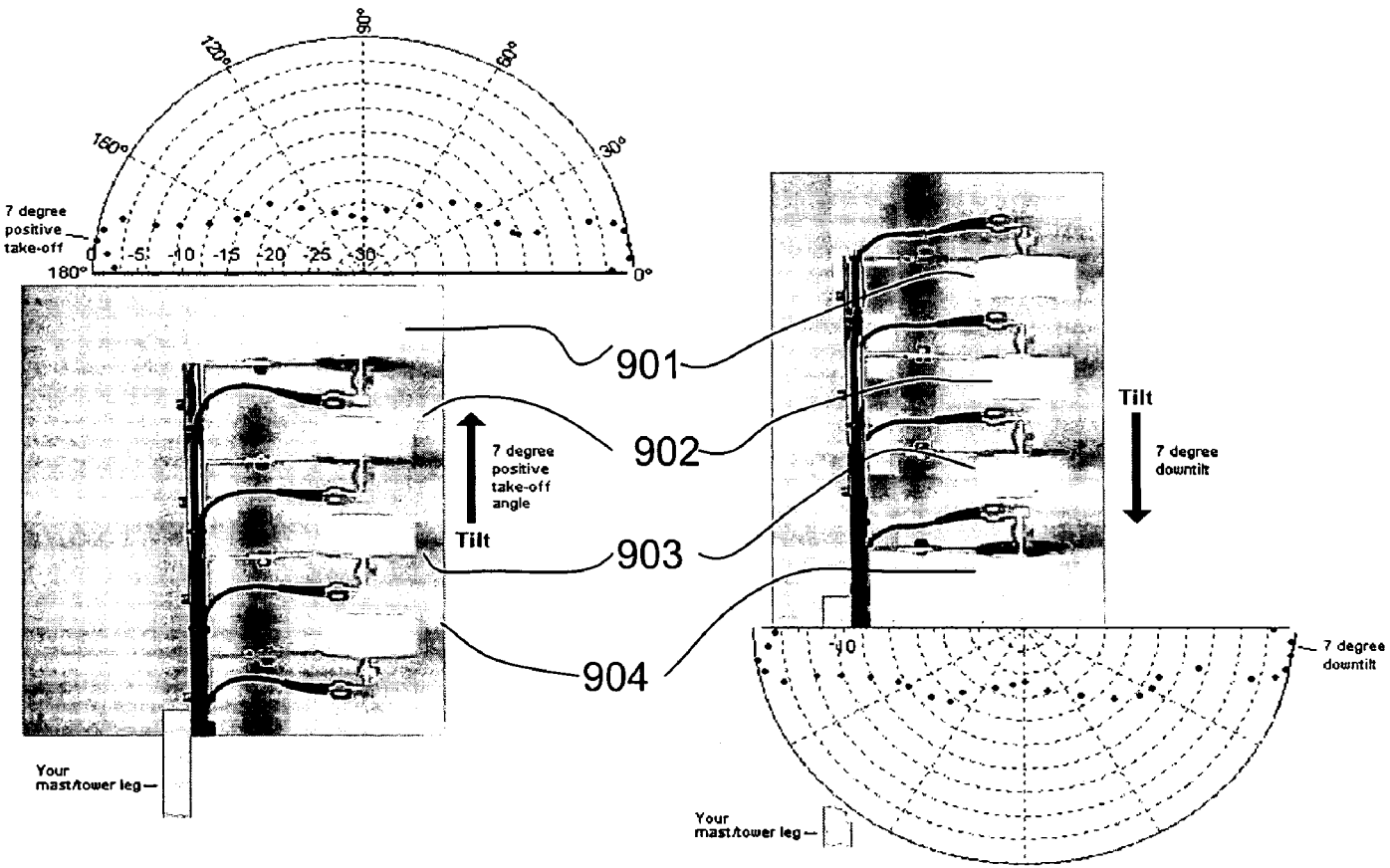
FIG. 9 illustrates an embodiment of a stacking configuration using multiple antennas of the type shown in FIG. 1 or FIG. 8, in accordance with various aspects of the present invention.

FIG. 9 illustrates an embodiment of a stacking configuration 900 using multiple antennas of the type shown in FIG. 1 or FIG. 8, in accordance with various aspects of the present invention. In FIG. 9, four multi-polarized antennas 901-904 are mounted in a co-linear relation to each other having substantially the same orientation and are each fed a radio frequency signal in phase upon transmission. As a result, the stacking configuration effectively compresses, by physical re-directivity (FIG. 1) as well as by accepted resonant co-linear gain, the lateral antenna pattern in the far field, producing more directivity and gain laterally compared to that of a single multi-polarized antenna. Similarly, upon reception, the antenna pattern of the four stacked multi-polarized antennas 901-904 provide increased lateral gain. The four antennas may be oriented right-side-up to provide more coverage above the horizontal, or upside-down to provide more coverage below the horizontal. In accordance with various embodiments of the present invention, the linear spacing between any two adjacent antennas is between $\frac{2}{3}\lambda$ and $3\lambda$ (where $\lambda$ is the radio frequency wavelength of transmission and/or reception). More or less spacing is not as effective in gain but may be effective in spatial diversity. Typically, the stacked antenna configuration 900 is mounted on a tower or mast to provide adequate height for unobstructed transmission and reception.

Multi-path cancellations/additions of signals resulting in "hot" and "null" spots occurs in three-dimensional space and is well known and accepted. It is theorized and realized by testing and evaluation that there are in fact partial final sine wave representations scattered about whereby a portion of one antenna/element in a multiple array (with or without significant pattern interaction) may capture a plus voltage area only, for example, while another antenna/element in the array captures a minus voltage area only. The two voltages are sine wave component additionals (multi-path fractional additionals) in the coaxial feed line, summing to a full opposing plus/minus signal in sinusoidal distribution along the coaxial feed line.

For example, a 12 dBi vertically stacked configuration of four 5 dBi antennas of the type shown in FIG. 1 proves to indeed be a 12 dBi configuration in a mid/far field anechoic test, exhibiting less gain than a single 13 dBi yagi antenna. However, in obstructed environment testing, the 12 dBi vertically stacked configuration exhibits distinctly greater peak signal than the 13 dBi yagi antenna regardless of how the yagi antenna, with its single driven element, is placed/positioned.

In accordance with an embodiment of the present invention, a conductive reflector plate or configuration may be used in conjunction with a stacked configuration of antennas to create a sector antenna configuration. For example, a conductive reflector configuration may be positioned along one side of the stacked configuration 900 of FIG. 9 to create an 18 dBi 120-degree sector antenna. Also, conductive reflector plates/configurations may be used in conjunction with single (not stacked) antennas to create a sector antenna.

In accordance with various embodiments of the present invention, the ground plane and impedance matching characteristics of the stacked configuration 900 or of a stacked sector configuration may be designed to provide dual band operation at, for example, approximately 2.4 GHz and approximately 5.6 GHz.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method to construct a multi-polarized antenna for transmitting and/or receiving radio frequency signals, said method comprising:

generating at least two radiative antenna elements each having a first end and a second end and each being tuned to a predetermined radio frequency;

electrically connecting said second ends of said radiative antenna elements at an apex point such that each radiative antenna element is disposed outwardly away from said apex point at an acute angle relative to and on a first side of an imaginary plane intersecting said apex point;

positioning an electrically conductive ground plane at and/or to a second side of said imaginary plane; and positioning a parasitic conductive reflector to said first side of said imaginary plane and away from said at least two radiative antenna elements.

2. The method of claim 1 further comprising connecting an electrical connector to said radiative antenna elements and said ground plane to allow connection of said antenna to a transmission line.

3. The method of claim 1 wherein said ground plane comprises a circular conductive ground plane having a radius of at least ¼ wavelength of a tuned radio frequency.

4. The method of claim 1 wherein generating each of said at least two radiative antenna elements comprises cutting a substantially linear conductive material to a predetermined physical length.

5. The method of claim 1 wherein said predetermined radio frequency for each of said radiative antenna elements is substantially the same for each of said radiative antenna elements.

6. The method of claim 1 wherein said predetermined radio frequency for each of said radiative antenna elements is substantially different for each of said radiative antenna elements.

7. The method of claim 1 wherein an angle between each of said radiative antenna elements and said ground reference is between 1 degree and 89 degrees.

8. The method of claim 1 further comprising connecting a mounting mechanism to said antenna to allow mounting of said antenna to another device or structure.

9. The method of claim 1 wherein said radiative antenna elements are equally spaced in angle circumferentially around 360 degrees.

10. The method of claim 1 further comprising mechanically connecting a motor to said multi-polarized antenna to allow rotation of said multi-polarized antenna about a defined axis of said antenna.

11. A multi-polarized antenna for transmitting and/or receiving radio frequency signals, said antenna comprising:

at least two radiative antenna elements each having a first end and a second end, and wherein said second ends of said radiative antenna elements are electrically connected at an apex point and are each disposed outwardly away from said apex point at an acute angle relative to and on a first side of an imaginary plane intersecting said apex point;

an electrically conductive ground plane located at and/or to a second side of said imaginary plane; and a parasitic conductive reflector positioned to said first side of said imaginary plane and away from said at least two radiative antenna elements.

12. The antenna of claim 11 further comprising a dielectric material serving to mechanically connect, at least in part, said radiative antenna elements to said ground plane while electrically insulating said radiative antenna elements from said ground plane.

13. The antenna of claim 12 further comprising an electrical conductor electrically connected to said radiative antenna elements at said apex point and extending away from said apex point toward a ground plane side of said antenna through said dielectric material to allow connection to a transmission line for interfacing said radiative antenna elements to a radio frequency transmitter and/or receiver.

14. The antenna of claim 11 further comprising an electrical connector to allow connection of said radiative antenna elements and said ground plane to a transmission line.

15. The antenna of claim 11 wherein said ground plane comprises a circular conductive ground plane having a radius of at least ¼ wavelength of a tuned radio frequency.

16. The antenna of claim 11 wherein said ground plane comprises a rectangular conductive ground plane having a length and width of at least ¼ wavelength of a tuned radio frequency.

17. The antenna of claim 11 wherein said ground plane comprises a triangular conductive ground plane having minimum distances from the center of the triangular conductive ground plane to the sides of the triangular conductive ground plane of at least ¼ wavelength of a tuned radio frequency.

18. The antenna of claim 11 wherein said ground plane comprises a plurality of conductive linear rods each having a length of at least ¼ wavelength of a tuned radio frequency.

19. The antenna of claim 11 wherein each of said radiative antenna elements are substantially linear and have a physical length determined by a pre-defined radio frequency.

20. The antenna of claim 11 wherein said acute angle between each of said radiative antenna elements and said ground reference is between 1 degree and 89 degrees.

21. The antenna of claim 11 further comprising a mounting mechanism to allow mounting of said antenna to another device or structure.

22. The antenna of claim 11 wherein said radiative antenna elements are equally spaced in angle circumferentially around 360 degrees.

23. The method of claim 1 further comprising mechanically connecting said radiative antenna elements to said ground plane using at least a dielectric material to electrically insulate said radiative antenna elements from said ground plane.

24. The method of claim 23 further comprising connecting an electrical conductor to said radiative antenna elements at said apex point such that said electrical conductor extends away from said apex point toward a ground plane side of said antenna and through said dielectric material to allow connection to a transmission line for interfacing said radiative antenna elements to a radio frequency transmitter and/or receiver.

25. The antenna of claim 11 wherein said parasitic conductive reflector is substantially conically shaped.

26. The antenna of claim 11 wherein said parasitic conductive reflector comprises a flat plane.

27. A stacked configuration of antennas for improving gain along a particular spatial dimension, said stacked configuration comprising at least two antennas co-linearly positioned in spatial proximity to each other along an imaginary line and having substantially the same spatial orientation, and said antennas each comprising at least two radiative antenna elements each having a first end and a second end, and wherein said second ends of said radiative antenna elements are electrically connected at an apex point and are each disposed outwardly away from said apex point at an acute angle relative to and on a first side of an imaginary plane intersecting said apex point, and an electrically conductive ground reference located at and/or to a second side of said imaginary plane, and wherein each antenna of said at least two antennas further comprises a parasitic conductive reflector positioned to said first side of said imaginary plane and away from said at least two radiative antenna elements.

28. The stacked configuration of claim 27 wherein a spatial separation distance between any two adjacent antennas of said at least two antennas is between ⅔ of a wavelength and 3 wavelengths of a predetermined radio frequency carrier signal. More or less spacing is not as effective in gain but is effective in spatial diversity.

29. The stacked configuration of claim 27 wherein said ground reference comprises a ground plane.

* * * * *